US011698195B2

(12) United States Patent
Song

(10) Patent No.: US 11,698,195 B2
(45) Date of Patent: Jul. 11, 2023

(54) ELECTRICAL COOKING APPLIANCE WITH AUTOMATIC CLEANING OF COOKING CHAMBER

(71) Applicant: LG ELECTRONICS INC., Seoul (KR)

(72) Inventor: Jeongryul Song, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 663 days.

(21) Appl. No.: 16/715,122

(22) Filed: Dec. 16, 2019

(65) Prior Publication Data

US 2020/0191404 A1 Jun. 18, 2020

(30) Foreign Application Priority Data

Dec. 14, 2018 (KR) ..... 10-2018-0162480

(51) Int. Cl.

| | |
|---|---|
| ***F24C 15/00*** | (2006.01) |
| ***F24C 7/08*** | (2006.01) |
| ***F24C 14/00*** | (2006.01) |
| ***F24C 15/32*** | (2006.01) |
| ***B08B 3/00*** | (2006.01) |

(52) U.S. Cl.

CPC ..... *F24C 15/003* (2013.01); *F24C 7/088* (2013.01)

(58) Field of Classification Search

CPC .... F24C 14/005; F24C 15/003; F24C 15/327; F24C 7/088

See application file for complete search history.

(56) References Cited

U.S. PATENT DOCUMENTS 5,058,194 A * 10/1991 Violi ..... F22B 1/284 392/400
2005/0056634 A1* 3/2005 Shozo ..... F24C 14/005 392/394
2006/0011071 A1* 1/2006 Cho ..... F24C 15/327 99/417
2006/0237428 A1 10/2006 Cho et al.

(Continued)

FOREIGN PATENT DOCUMENTS

DE 2842771 A * 4/1980 ..... F24C 14/005
DE 197 41 881 3/1999

(Continued)

OTHER PUBLICATIONS

Korean Notice of Allowance dated Apr. 20, 2020.

(Continued)

*Primary Examiner* — Jorge A Pereiro
*Assistant Examiner* — Logan P Jones
(74) *Attorney, Agent, or Firm* — Ked & Associates

(57) ABSTRACT

An electrical cooking appliance with automatic cleaning of a cooking chamber is provided. The appliance may include a steam supply device configured to generate steam and supply the steam to the cooking chamber; a water supply pump that supplies water from a water tank to the steam supply device; a water discharge pump that collects condensed water from the steam supply device into the water tank; and a controller configured to activate the water supply pump to supply water to the cooking chamber to clean the cooking chamber; and activate the steam supply device to supply steam to the cooking chamber to clean the cooking chamber.

18 Claims, 10 Drawing Sheets

(56) References Cited

U.S. PATENT DOCUMENTS

| | | | | |
|---|---|---|---|---|
| 2006/0249136 | A1* | 11/2006 | Reay | F24C 15/327 126/20 |
| 2014/0097173 | A1* | 4/2014 | Becker | A47J 27/04 126/369 |
| 2014/0175085 | A1 | 6/2014 | Yang et al. | |
| 2018/0070596 | A1* | 3/2018 | Kim | F24C 15/327 |
| 2018/0332993 | A1* | 11/2018 | Cho | F24C 7/085 |
| 2019/0203944 | A1 | 7/2019 | Cho et al. | |
| 2019/0309956 | A1 | 10/2019 | Buschman et al. | |
| 2019/0309957 | A1 | 10/2019 | Buschman et al. | |
| 2019/0387913 | A1 | 12/2019 | Lee et al. | |

FOREIGN PATENT DOCUMENTS

| | | | | |
|---|---|---|---|---|
| EP | 1 616 516 | | | 1/2006 |
| EP | 2366315 | | | 9/2011 |
| EP | 2 746 682 | | | 6/2014 |
| EP | 3 553 394 | | | 10/2019 |
| KR | 10-2006-0115332 | | | 11/2006 |
| KR | 20080032468 | A | * | 4/2008 |
| KR | 10-2010-0111203 | | | 10/2010 |
| KR | 10-1217996 | | | 1/2013 |
| KR | 10-1876117 | | | 7/2018 |
| WO | WO 2018/048119 | | | 3/2018 |
| WO | WO 2018/139839 | | | 8/2018 |

OTHER PUBLICATIONS

European Search Report dated Apr. 20, 2020.
European Search Report dated Feb. 14, 2023 issued in Application No. 19216499.4.

* cited by examiner

ELECTRICAL COOKING APPLIANCE WITH AUTOMATIC CLEANING OF COOKING CHAMBER

CROSS-REFERENCE TO RELATED APPLICATION(S)

This application claims priority to Korean Patent Application No. 10-2018-0162480, filed in Korea on Dec. 14, 2018 in the Korean Intellectual Property Office, the disclosure of which is hereby incorporated by reference in its entirety.

BACKGROUND

1. Field

An electrical cooking appliance having a steam supply device, and more particularly, an electrical cooking appliance in which cleaning of a cooking chamber, such as an oven, may be automatically performed by a steam supply device is disclosed herein.

2. Background

An electrical cooking appliance, such as an oven, is a home appliance that cooks food or other items (hereinafter, collectively "food") using heat. In recent years, an electrical cooking appliance equipped with a steam supply device to inject steam into a cooking chamber to improve food taste and minimize destruction of nutrients contained in food has been developed.

In order to maximize steam generation efficiency of the steam supply device, a shape of a steam generator, a steam supply pattern according to a position of the steam generator, and a water supply operation for steam generation and supply are very important factors. In order to ensure that these important factors may be applied correctly, the steam supply device includes a water tank that supplies water to the steam generator that generates steam, and a connection pipe configured to allow water inside of the water tank to be transferred to the steam generator. Further, the steam generator includes a water storage in which water supplied from the water tank is accommodated therein, and a steam heater that generates steam by heating water in the water storage.

In the electrical cooking appliance such as an oven equipped with the steam supply device as described above, the water injected through the water tank is introduced into the water storage via the connection pipe. Water entering the water storage is heated by the steam heater to produce steam. Therefore, because the steam supply device must supply the steam to the cooking chamber while cooking is performed, it is very important to ensure that the water supply from the water tank is smoothly executed depending on a water level of the water storage. Thereafter, the steam generated by the steam supply device is introduced into the cooking chamber. Then, the cooking using the steam is performed while the steam circulates in the inside of the cooking chamber.

In one example, a conventional electrical cooking appliance requires the user to clean the cooking chamber, such as an oven, in which food is cooked according to a preset manual. In the conventional electrical cooking appliance, a cleaning function to execute cleaning of the cooking chamber was provided. However, this function simply sprays water into the cooking chamber and facilitates water discharge from the chamber. As such, when a cooking chamber cleaning ability is not sufficient, and thus, the cooking chamber cleaning is not reliably performed, it becomes more difficult to clean greasy or strongly adhered contaminants in the cooking chamber, such that user's convenience and satisfaction were deteriorated.

BRIEF DESCRIPTION OF THE DRAWINGS

Embodiments will be described with reference to the following drawings in which like reference numerals refer to like elements, and herein.

DETAILED DESCRIPTION

Figure 1:
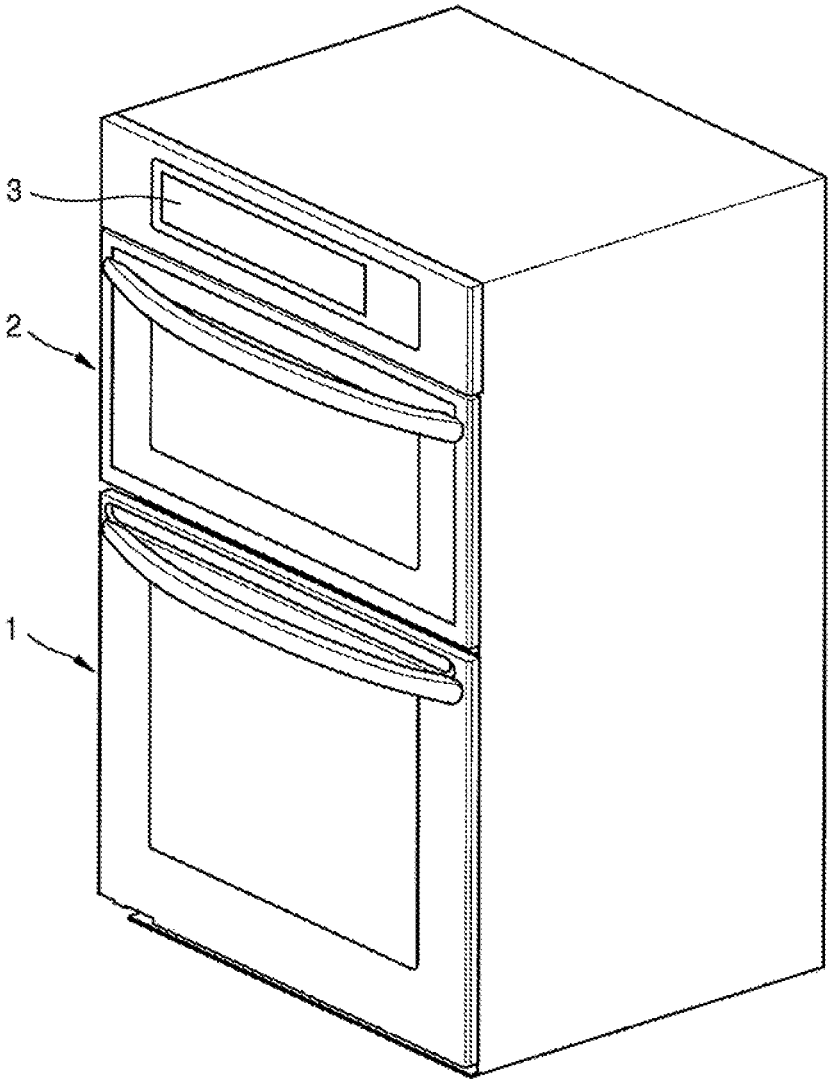
FIG. 1 is a perspective view showing an electrical cooking appliance capable of automatic cleaning of a cooking chamber according to an embodiment.

For simplicity and clarity of illustration, elements in the figures are not necessarily drawn to scale. The same reference numbers in different figures denote the same or similar elements, and as such perform similar functionality. Further, in the following detailed description, numerous specific details are set forth in order to provide a thorough understanding. However, it will be understood that embodiments may be practiced without these specific details. In other instances, well-known methods, procedures, components and circuits have not been described so as not to unnecessarily obscure aspects.

Examples of various embodiments are illustrated and described further below. It will be understood that the description herein is not intended to limit the claims to the specific embodiments described. On the contrary, it is intended to cover alternatives, modifications, and equivalents as may be included within the spirit and scope as defined by the appended claims.

The terminology used herein is for the purpose of describing particular embodiments only and is not intended to be limiting. As used herein, the singular forms "a" and "an" are intended to include the plural forms as well, unless the context clearly indicates otherwise. It will be further understood that the terms "comprises", "comprising", "includes", and "including" when used in this specification, specify the presence of the stated features, integers, operations, elements, and/or components, but do not preclude the presence or addition of one or more other features, integers, operations, elements, components, and/or portions thereof. As used herein, the term "and/or" includes any and all combinations of one or core of the associated listed items. Expression such as "at least one of" when preceding a list of elements may modify the entire list of elements and may not modify the individual elements of the list.

It will be understood that, although the terms "first", "second", "third", and so on may be used herein to describe various elements, components, regions, layers and/or sections, these elements, components, regions, layers and/or sections should not be limited by these terms. These terms are used to distinguish one element, component, region, layer or section from another element, component, region, layer or section. Thus, a first element, component, region, layer or section described below could be termed a second element, component, region, layer or section, without departing from the spirit and scope.

In addition, it will also be understood that when a first element or layer is referred to as being present "on" or "beneath" a second element or layer, the first element may be disposed directly on or beneath the second element or may be disposed indirectly on or beneath the second element with a third element or layer being disposed between the first and second elements or layers. It will be understood that when an element or layer is referred to as being "connected to", or "coupled to" another element or layer, it can be directly on, connected to, or coupled to the other element or layer, or one or more intervening elements or layers may be present. In addition, it will also be understood that when an element or layer is referred to as being "between" two elements or layers, it can be the only element or layer between the two elements or layers, or one or more intervening elements or layers may also be present.

Unless otherwise defined, all terms including technical and scientific terms used herein have the same meaning as commonly understood by one of ordinary skill in the art to which this inventive concept belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

Hereinafter, embodiments will be described with reference to the accompanying drawings.

Figure 2:
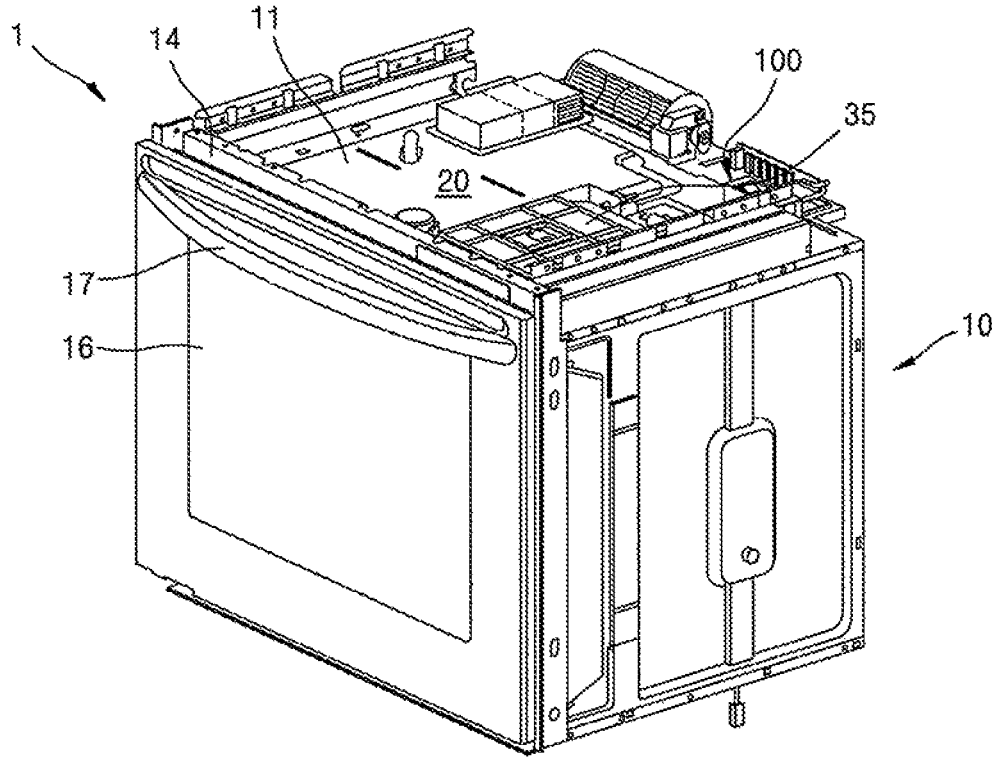
FIG. 2 is a perspective view in which a portion of the electrical cooking appliance shown in FIG. 1 is separated therefrom.
Figure 3:
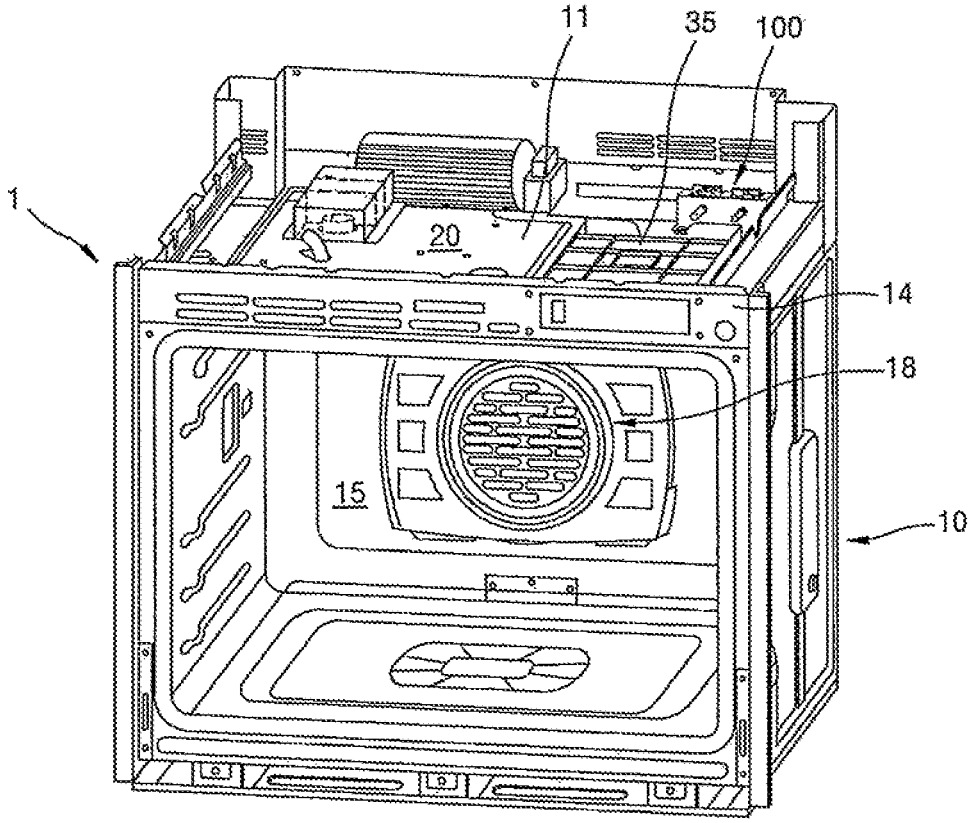
FIG. 3 is a perspective view showing a state in which a door is removed from the electrical cooking appliance shown in FIG. 2.

FIG. 1 is a perspective view of an electrical cooking appliance equipped with a steam supply device according to an embodiment. FIG. 2 is a perspective view in which a portion of the electrical cooking appliance shown in FIG. 1 is separated therefrom. FIG. 3 is a perspective view showing a state in which a door is removed from the electrical cooking appliance shown in FIG. 2.

First, referring to FIG. 1, an electrical cooking appliance according to an embodiment may include a lower first unit 1, an upper second unit 2, and a controller 3 disposed above the second unit 3. Each of the first unit 1 and second unit 2 may be embodied as a hermetically sealed cooking device, such as an electric oven. However, embodiments are not limited thereto. For example, the cooking appliance may be configured such that the lower first unit 1 is embodied as an electric oven and the upper second unit 2 is embodied as a gas oven. In another example, a hermetic cooking appliance other than an oven, such as a microwave oven, may be applied as the first unit 1, while an open cooking device, such as a cooktop, hop, or grill, for example, may be applied to the second unit 2 and located on top of the first unit 1.

The controller 3 may include a control board including at least one display panel, a sound speaker, a plurality of manipulation switches, and/or a microprocessor unit (MPU), for example.

The controller 3 may control a cooking operation of the first and second units 1 and 2 according to a user's control command from the plurality of manipulation switches, and control a steam generation operation of the steam supply device. Specific cooking operation control and steam generation control under the controller 3 will be described with reference to the accompanying drawings.

In one example, hereinafter, a configuration of a cooking appliance will be described using an example in which both the first unit 1 and second unit 2 are embodied as electric ovens. In this example, a configuration of the cooking appliance will be described based on a configuration of the first unit 1.

Referring to FIG. 2 and FIG. 3, the first unit 1 may include a main body 10 forming an appearance thereof. The main body 10 may have an approximately rectangular parallelepiped shape and may be made of a material with a predefined strength to protect a large number of components installed in an inner space thereof.

The main body 10 may include a cavity 11 defining a frame of the main body 10 and a front plate 14 disposed in front of the cavity 11 to form a front face of the main body 10. Inside of the cavity 11, a cooking chamber 15 may be formed. In the front plate 14, an opening may be defined that opens the cooking chamber 15 forwards.

The cooking chamber 15 may be formed inside of the main body 10. The cooking chamber 15 may have a rectangular parallelepiped shape with an open front face. Food may be cooked by heating an inner space of the cooking chamber 15 while the cooking chamber 15 is shielded. That is, in the electrical cooking appliance, the inner space of the cooking chamber 15 refers to a space in which food is cooked.

The electrical cooking appliance may include a plurality of cooking heaters **18*n* that heat the cooking chamber 15, a convection fan 18, and a ventilation fan 18*a*. The cooking heaters 18*n* may be respectively disposed on upper, lower, left and right or lateral sides of the cooking chamber 15 to heat the inner space of the cooking chamber 15. The convection fan 18 may induce convection of hot air to heat an entire inner space of the cooking chamber 15**.

In front of the main body 10, a door 16 that selectively opens and closes the cooking chamber 15 may be pivotally disposed. The door 16 may open and close the cooking chamber 15 in a pull-down fashion in which a top of the door 16 pivots up and down about a bottom of the door 16.

The door 16 may have a cube shape having a predefined thickness. In a front face of the door 16, a handle 17 may be installed to allow the user to grab the door 16 to pivot the door 16.

Above the main body 10, that is, in a space between the first unit 1 and the second unit 2 stacked thereon, an electrical-component receiving space 20 may be formed in which electrical components may be contained. A lower boundary face of the electrical-component receiving space 20 may be defined by a top face of the cavity 11, while an upper boundary face of the electrical-component receiving space 20 may be defined by a bottom face of the second unit 2. Further, a front face of the electrical-component receiving space 20 may be shielded by the front plate 14.

Figure 4:
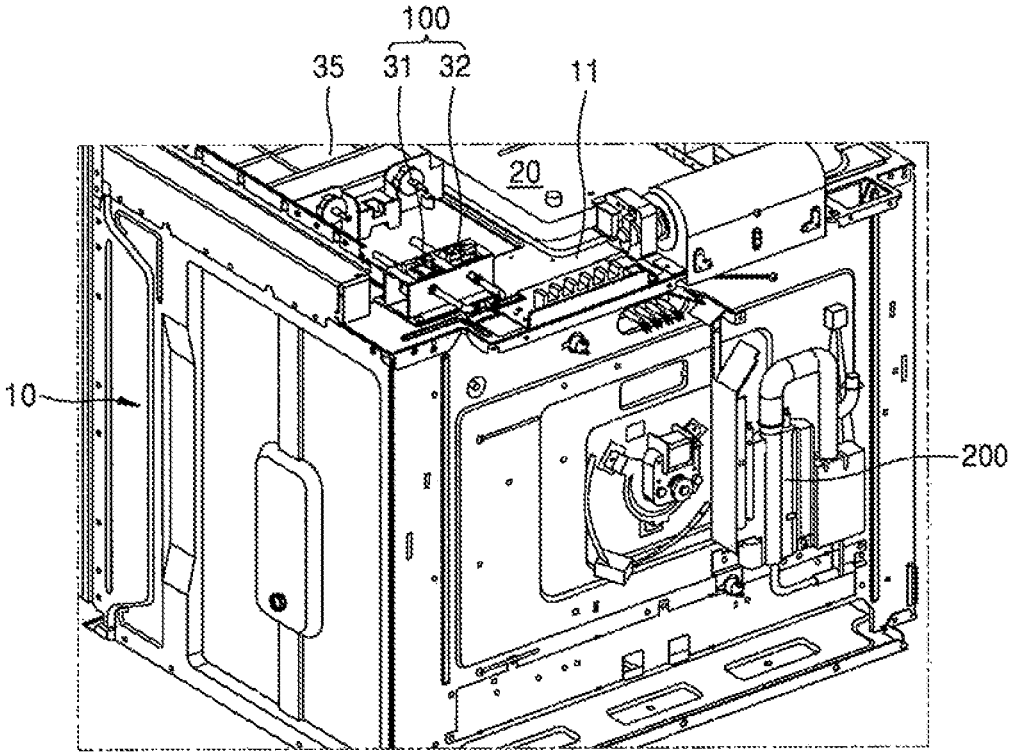
FIG. 4 is a perspective view of a mounting configuration of a steam supply device according to an embodiment.

FIG. 4 is a block diagram showing a mounting configuration of a steam supply device according to an embodiment. Referring to FIG. 4, the steam supply device 200 may be mounted on a back of the main body 10. More specifically, steam supply device 200 may be configured to supply steam from a rear of the main body 10 into the cooking chamber 15. A water tank 35 may be mounted on a top face of the main body 10. Thus, a fluid channel that connects the water tank 35 and the steam supply device 200, and a pump module or pump 100 connected to the channel may be further included.

The water tank 35 may be provided as a drawer type water tank disposed on the top face of the main body 10, and may be configured to be separable from the cavity 11. Further, the water tank 35 may be retractable and extendable into and from a tank housing. The tank housing may be fixedly disposed on the top face of the cavity 11. On a rear face of the tank housing, a water tank sensor may be disposed that detects whether the water tank 35 is attached or detached to or from the housing in real time, and transmits an attachment and detachment detection signal of the water tank 35 to the controller 3 in real time.

A water supply port and a water discharge port may protrude from the back face of the tank housing. Further, a water supply channel and a water discharge channel may be provided in the form of a flexible tube.

The pump module 100 includes a water supply pump 31 that supplies water in the water tank 35 to the steam supply device 200, and a water discharge pump 32 that returns water remaining in the steam supply device 200 to the water tank 35. The water discharge pump 32 may be defined as a collection pump because the pump 32 functions to return water from the steam supply device 200 to the water tank 35.

A channel (not shown) that connects the water tank 35 and the steam supply device 200 may include a water supply channel connected to a water supply port of the water supply pump 31, a water discharge channel connected to a water discharge port of the water discharge pump 32, and a common channel connected to a point where the water supply channel and the water discharge channel meet with each other. With this structure, ends of the water supply channel and the water discharge channel extending from outlets of the water supply pump 31 and the water discharge pump 32 respectively meet with each other at one point. The common channel (not shown) may be extended from the point. An outlet end of the common channel may be connected to a water supply port and a water discharge port of the steam supply device 200.

Figure 5:
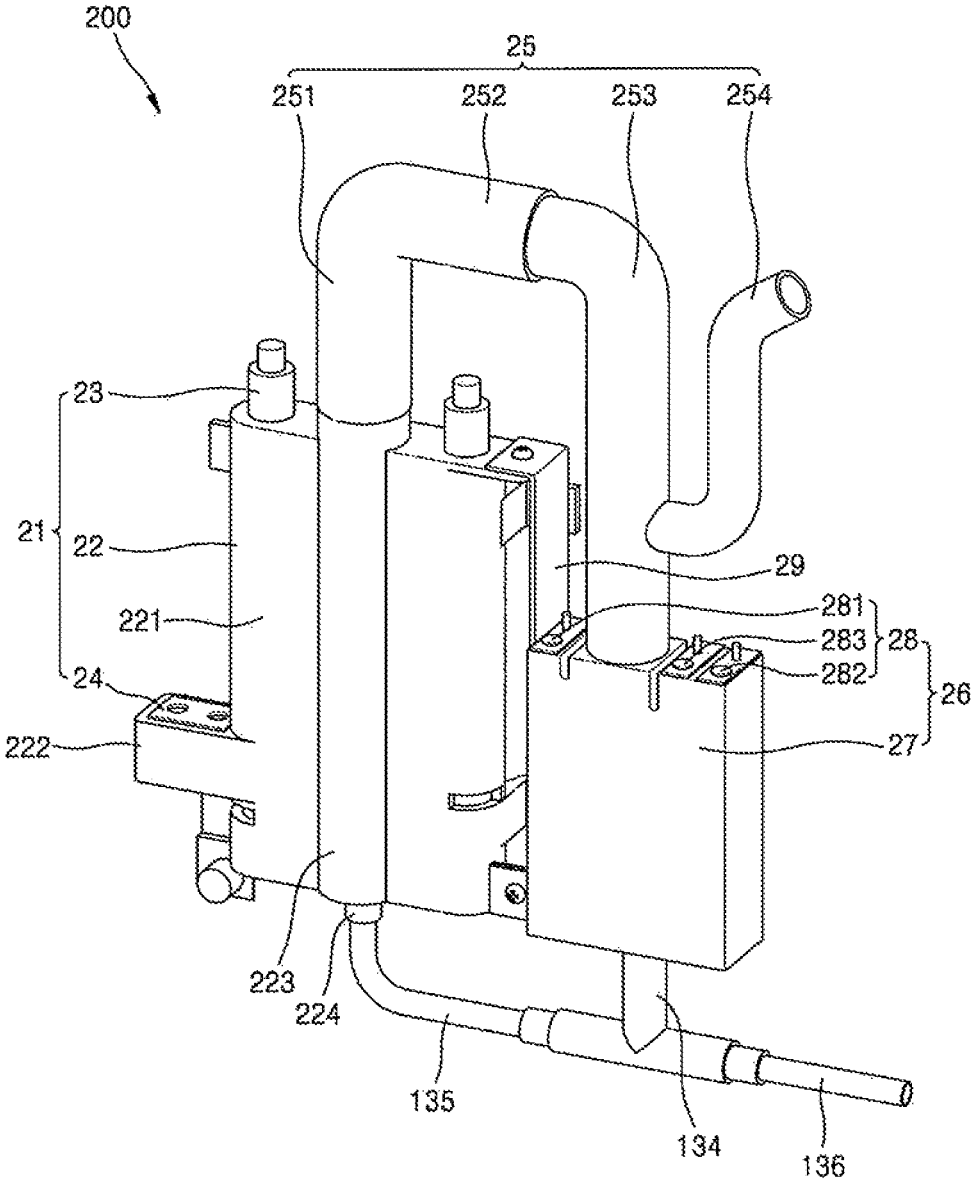
FIG. 5 is a side perspective view of the steam supply device shown in FIG. 4.

FIG. 5 is a side perspective view of steam supply device shown in FIG. 4. As shown in FIG. 5, a water supply port 224 of the steam supply device 200 may be connected to a water supply channel 135. A water discharge or collection channel 134 may be connected to a water discharge port of the steam supply device 200. Similarly, at a point where the water supply channel 135 and the water discharge channel 134 meet with each other, a common channel 136 may be connected to both the channels 135 and 134. The command channel 136 may be integrally connected to a common channel of the water tank 35.

According to a channel structure having the above configuration, water filled in the water tank 35 may be supplied to the common channel 136 of the steam supply device 200 along the water supply channel 135 and the common channel 136 thereof under an operation of the water supply pump 31. Further, the steam supply device 200 may receive steam through the common channel 136 and the water supply channel 135 thereof to generate steam. After the steam supply is completed, water remaining in the steam supply device 200 may be transferred to the common channel 136 and the water tank 35 through the water discharge channel 134 under operation of the water discharge pump 32.

Referring to FIG. 5, a configuration and function of the steam supply device 200 will be described as follows. Referring to FIG. 5, the steam supply device 200 may include a steam supply 21 that generates and supplies steam, and a steam supply channel 25 that guides the steam generated from the steam supply 21 into the cavity 11, and a condensed water storage 26 formed between one end of the steam supply channel 25 and the water supply channel 35 of the steam supply 21 and storing therein condensed water resulting from the steam generation of the steam supply 21.

The steam supply 21 may include a casing 22 of a cast type, a steam heater 23 embedded in the casing 22 and configured for generation of steam, and a thermistor 24 installed in the casing 22 to prevent overheating of the casing 22. With this structure, the condensed water storage 26 may be coupled to a side face of the steam supply 21 via a fastening bracket 29.

The casing 22 of the steam supply 21 may include a heater containing portion 221 which may be roughly hexahedral, a thermistor mount 222 projected from one side face of the heater containing portion 221, and having a thermistor 24 mounted therein, a steam generator 223 extending in the form of a cylinder in a middle of the heater containing portion 221, and a water supply port 224 that extends from a bottom of the heater containing portion 221. The steam heater 23 may be embodied as a U-shaped sheath heater. Both ends of the steam heater 23 may protrude from the casing 22, more specifically, a top face of the heater containing portion 221. Further, the steam generator 223 may be formed between both ends of the steam heater 23. With this structure, the heater containing portion 221 may be longer in a vertical direction thereof than in a lateral direction and may have a thickness larger than a diameter of the steam heater 23.

The steam generator 223 may be formed in a hollow cylindrical shape to receive the steam and water therein. A rear end of the steam generator 223 may be spaced from a rear end of the heater containing portion 221.

Further, as shown, an inner diameter of the steam generator 223 may be designed to be larger than a thickness of the heater containing portion 221 so that a front end of the steam generator 223 further protrudes from a front face of the heater containing portion 221. However, embodiments are not limited thereto. Further, the steam generator 223 may be a cylinder with a same inner diameter or in a truncated cone type cylinder having an inner diameter increasing from a bottom to a top, for example.

A top of the steam generator 223 may further extend by a predefined length from a top face of the heater containing portion 221 or the casing 22. A top portion of the steam generator 223 protruding from the top face of the heater containing portion 221 may be defined as an ejection port.

In one example, the steam supply channel 25 may include an upward extension 251 fitting into an outer circumference of the ejection port and extending upwards, a bent portion 252 bent from a top of the upward extension 251 and extending horizontally, a downward extension 253 bent from an end of the bent portion 252 and extending downwards, and a cavity connector 254 extending from a point of the downward extension 253. Further, the bent portion 252 may extend horizontally.

The cavity connector 254 may have a diameter smaller than a diameter of the downward extension 253 and may be bent in an approximately S shape. The cavity connector 254 may extend horizontally from a point of the downward extension 253 and then be bent and extend upwards, and be bent again and extend horizontally. An end of the cavity connector 254 may pass through a rear face of the cavity 11 and communicate with an interior of the cavity 11. Therefore, hot steam moving along the steam supply channel 25 supplied into the cavity 11 through the cavity connector 253.

As a volume of the cylindrical steam generator 223 is small, boiling occurs vigorously when water supplied to the steam generator 223 is heated. Especially when bumping occurs, hot water together with steam flows out of the steam generator 223. With this structure, it is necessary to properly design a shape of the steam supply channel 25 to prevent the boiling water from entering the cavity 11.

The steam supply channel 25 may be designed to be bent in an N letter shape so that the boiling water falls by gravity without entering the cavity 11. In addition, the cavity connector 254 may be branched from one side of the downward extension 253 and extends upwards to ensure that only gas among liquid and gas on the steam supply channel 25 is fed into the cavity 11.

Condensed water generated in the steam supply process needs to be collected into the steam generator 223 rather than into the cavity 11. To this end, the condensed water storage 26 may be mounted on a distal end of the downward extension 253. A condensed water storage space may be formed inside of the condensed water storage 26. The water discharge channel 134 may extend from a bottom of the condensed water storage 26.

The controller 3 may continue to operate the water supply pump 31 while a water level in the steam generator 223 of the steam supply 21 and the condensed water storage 26 is fully high and continue to supply water to the steam generator 223 through the water supply channel 135 and the common channel 136, so hot water is supplied into the cooking chamber 15 of the cavity 11 through the cavity connector 253. This operation may be performed when inner cleaning of the cooking chamber 15 is performed. In the inner cleaning of the cooking chamber 15, hot water may be supplied to a wall and bottom of the cooking chamber 15, and then hot steam supplied into the cooking chamber 15. The convection fan 18 and at least one cooking heater may be operated during steam supply for the inner cleaning of the cooking chamber 15.

After the steam supply is stopped or the water supply to the inner cooking chamber 15 is stopped, the water from the condensed water storage 26 may be collected into the water tank 35. The water discharge channel 134 for collecting or discharging water from the condensed water storage 26 into the water tank 35 may be connected to the common channel 136 which connects the pump module 30 and the water supply port 224. Thus, condensed water discharged along the water discharge channel 134 may be supplied back to the steam generator of the steam supply 21 along with water supplied along the common channel 135.

In one example, the N-shaped channel connecting the steam supply 21 and the housing 27 may be defined as a first channel, while the cavity connector 254 branching from the first channel may be defined as a second channel.

Hereinafter, a cross-sectional structure and an inner structure of the steam supply 21 and the condensed water storage 26 will be described with reference to the accompanying drawings.

Figure 6:
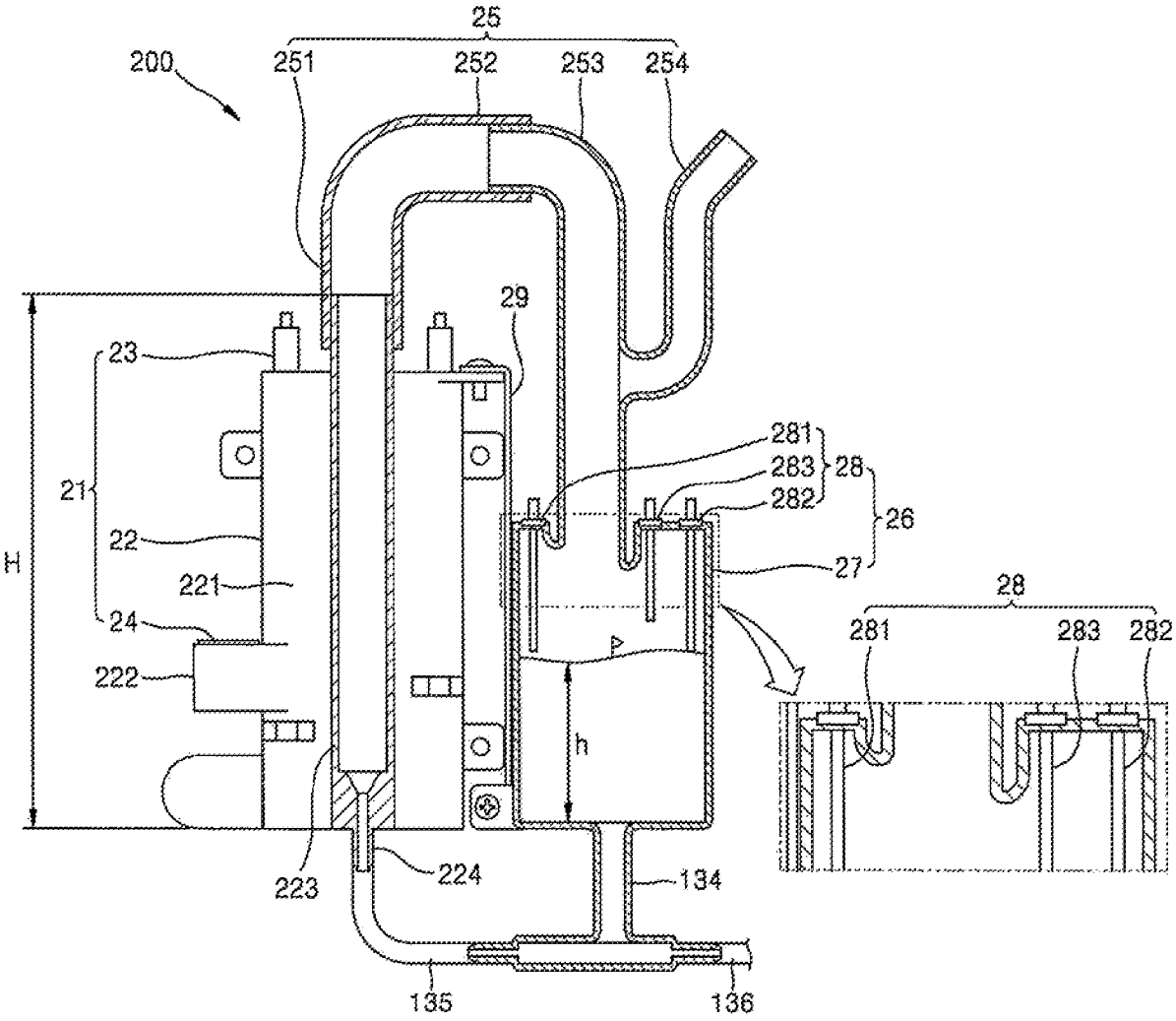
FIG. 6 is a vertical cross-sectional view of the steam supply device shown in FIG. 5.

FIG. 6 is a vertical cross-sectional view of the steam supply device shown in FIG. 5. Referring to FIG. 6, a water-level sensing module or sensor 28 may be mounted inside of the housing 27 of the condensed water storage 26 to measure a water level inside of the housing 27. An inner space of housing 27 and an inner space of steam generator 223 may communicate with each other through the water supply channel 135 and water discharge channel 134. Therefore, the water level inside of the housing 27 may be considered as a water level inside of the steam generator 223. Therefore, there is no need to install a water-level sensor inside the steam generator 223. The controller 3 may determine the water level of the steam generator 223 based on the sensed water level of the condensed water storage 26.

The water-level sensing module 28 may include a plurality of electrode type water-level sensors. The electrode type water-level sensor has an advantage of excellent heat resistance at high temperatures compared to other types of water-level sensors, such as capacitive sensors.

The electrode type water-level sensing module 28 may pass through the top face of the housing 27 and be inserted vertically into the housing 27 and extend downwards. When the water-level sensing module 28 is inserted in a horizontal direction from a side face of the housing 27, water supplied to the steam generator 223 may leak through a through hole through which the water-level sensing module 28 passes. Thus, the water-level sensing module 28 is inserted to pass through a top face of the housing 27 to prevent the leakage problem.

Further, because an ability of the electrode-type water-level sensor to withstand high temperature heat is superior to that of a capacitive sensor, the electrode-type water-level sensor is advantageous in a situation in which the sensor is exposed to high temperature steam.

The water-level sensing module 28 may include a common electrode 281, a low water-level sensor 282 of an electrode type, and a high water-level sensor 282 of an electrode type. With this structure, a bottom of the common electrode 281 may be at a same level as a bottom of the low water-level sensor 282 or extend closer to a bottom of the housing 27. Further, a bottom of the high water-level sensor 283 may be located above a bottom of the low water-level sensor 282. Therefore, when water is filled in the housing 27, and a water-level h reaches the bottom of the high water-level sensor 282, this water level is detected as a high water-level. Further, when the water-level h reaches the low water-level sensor 282 below the high water-level sensor 283, the low water-level sensor 282 detects the low water-level as current flows between the sensor 282 and the common electrode 281. In one example, bottoms of the water-level sensor electrodes 281, 282 and 283 may be coated with Teflon to minimize malfunction.

When the common electrode 281 and the low water-level sensor 282 and the high water-level sensor 283 corresponding to working electrodes are disposed at one side around the downward extension 253, flowing water increases a possibility of malfunction and noise generation. In order to minimize these problems, a mounting position of the common electrode 281 may be opposite to mounting positions of the working electrodes around the downward extension 253, such that a possibility of the generation of noise and a generation frequency thereof due to electrode malfunction may be minimized. Disposing the common electrode 281 and the working electrodes at opposite sides around the downward extension 253 may minimize a possibility of water flowing along the downward extension 253 and flowing along both the common electrode 281 and the working electrode to generate noise. In one example, the common electrode 281 may be disposed at a left or first side around the downward extension 253, while the working electrodes may be disposed at a right or second side around the downward extension 253. In addition, because a frequency of use of the low water-level sensor 282 is higher than that of the high water-level sensor 283, the low water-level sensor 282 may be located more outwardly than the high water-level sensor 283 so that the sensor 282 is located farthest from the downward extension 253, thereby to prevent malfunction thereof.

Further, means for minimizing a possibility of ejected water and condensed water flowing along and on the electrodes 281, 282, and 283 may be formed on a top face of the housing 27 as a face between the downward extension 253 and the electrodes. This means may be embodied as a predefined depth recess defined in the top face of the housing 27. In other words, when viewed from an outside of the housing 27 the means may be defined as a recess. When viewed from the inside of the housing 27, the mean may be defined as a protrusion or step.

In one example, optimum steam generation efficiency may be achieved when the water-level h in the steam supply 21 is maintained at 25% of a height H of the steam generator 223 in a condition of maintaining a temperature of the steam supply 21 having a cast type casing 22 having the U-shaped sheath steam heater 23 buried therein and having the cylindrical steam generator in a center thereof to be 180° C.

When a water level of the steam generator 223 of the steam supply 21 is kept at a low water-level, a temperature of the steam generator 223 is constantly rising up. Thus, the steam heater 23 may be switched off to prevent overheating thereof. As a result, a steam generation time duration may be shortened, resulting in a problem that the steam generation efficiency is lowered. Conversely, when the interior water level of the steam generator 223 remains at a high water-level, the temperature of the steam generator 223 is lower than a target temperature, so that it takes longer to generate steam, and, further bumping may be generated in which steam and water are ejected together toward an outlet of the steam generator 223.

Figure 7:
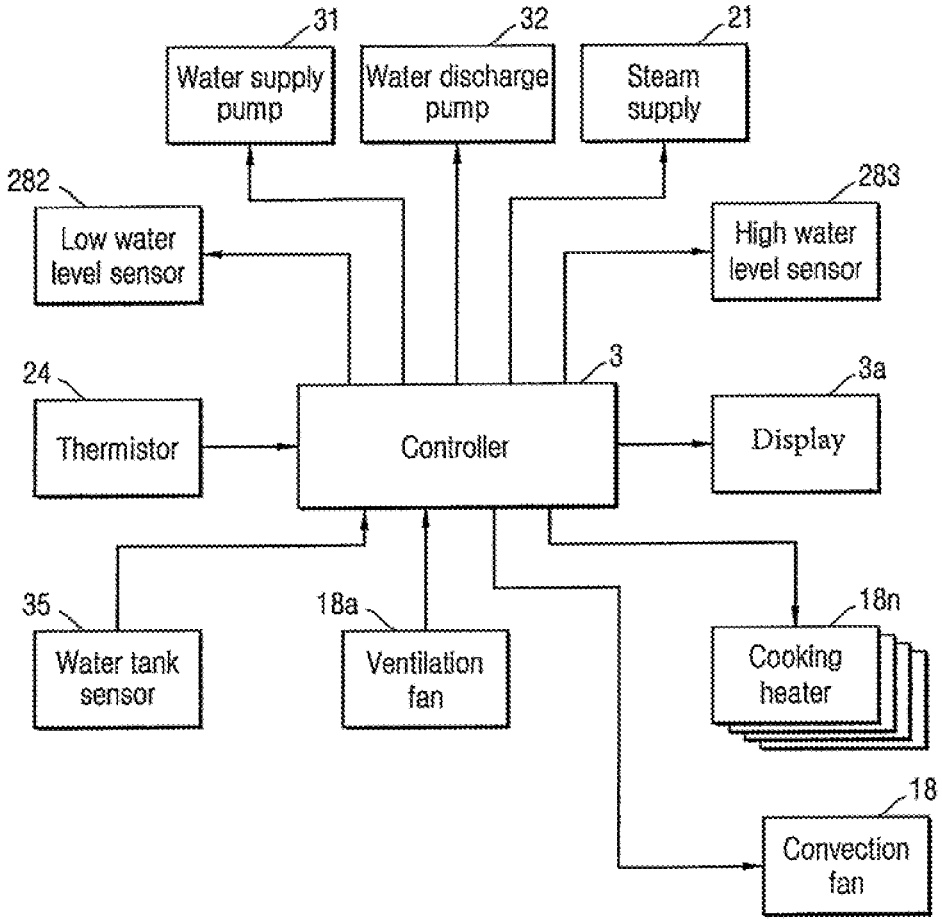
FIG. 7 is a block diagram showing an electrical connection relationship between a controller shown in FIG. 1 and components of the electrical cooking appliance shown in FIG. 2 to FIG. 6.

FIG. 7 is a block diagram showing an electrical connection relationship between the controller shown in FIG. 1 and components of the electrical cooking appliance shown in FIG. 2 to FIG. 6.

Referring to FIG. 7, the controller 3 may detect the water level of the steam generator 223 using the water-level sensing module 28 equipped with the low water-level sensor 282 and the high water-level sensor 283. The water tank sensor 35 may detect whether the water tank 35 is mounted on the housing. Accordingly, the controller 3 may control an on/off operation of the water supply pump 31 or the water discharge pump 32 based on a water-level change in the steam generator 223 as detected by the water-level sensing module 28. With this structure, controller 3 may display or present a water-level status of the steam generator 233 and presence or absence of the water tank 35 on a display or display panel 3*a* or from an alarm generation speaker.

The controller 3 may control a steam generation operation of the steam supply 21 according to a user's control command input from the plurality of manipulation switches, for example, a touch button or dial switch. With this structure, the controller 3 may sense a steam generation temperature using the thermistor 24 of the steam supply 21 and may reliably control the steam generation of the steam supply 21 to prevent the supply 21 from overheating. In addition, the controller 3 may control an on/off operation of at least one cooking heater 18*n* and the convection fan 18 according to a user's control command from the plurality of manipulation switches, thereby to allow the cooking chamber 15 to be heated.

Further, when an automatic cleaning execution is input via the multiple manipulation switches from the user, the controller 3 may continuously activate the steam supply 21 and the water supply pump 31 of the steam supply device 200 to allow hot water to be supplied to the cooking chamber 15. Further, the controller 3 may operate the water discharge pump 32 for a predefined duration, and then activate the steam discharge device 200, the convection fan 18, and the at least one cooking heater 18*n*, such that the cooking chamber 15 may be automatically cleaned.

Hereinafter, description of the controller 3 for controlling an overall operation of the electrical cooking appliance including the steam supply device 200, the plurality of cooking heaters 18*n*, and/or the convection fan 18, for example, will be described.

The controller 3 may detect the water level of the steam supply 21 in real time using the low water-level sensor 282 and the high water-level sensor 283 of the water-level sensing module 28. The low water-level sensor 282 and high water-level sensor 283 may detect the water-level of the condensed water storage 26. However, as mentioned above, the condensed water storage 26 and the steam generator 223 may be installed at the same height so that the water levels thereof are the same.

The controller 3 may control an on/off operation of the water supply pump 31 or the water discharge pump 32 based on the water-level change of the steam generator 233 as sensed in real time from the water-level sensing module 28. More specifically, when the water level of the steam supply 21 is maintained at a low water level for a long time, the temperature of the steam generator 223 continues to rise up and the steam heater 23 may be switched off to prevent overheating thereof. Thus, when the inner water level of the steam generator 223 is maintained at a low water level for a duration larger than or equal to a preset duration, the controller 3 may turn the water supply pump 31 on for a preset duration. With this structure, the activation duration of the water supply pump 31 may be preset to seconds, minutes, or hours, depending on a performance of the water supply pump 31. Alternatively, the controller 3 may turn on the water supply pump 31 until a high water-level is detected by the high water-level sensor 283.

In contrast, when the inner water-level of the steam generator 223 remains at a high water-level, the steam generation takes longer, and bumping may occur. Thus, the water discharge pump 32 may be turned on for a preset duration. Likewise, the activation duration of the water discharge pump 32 may be preset to seconds, minutes, and/or hours, for example, depending on the performance of the water discharge pump 32. Alternatively, the controller 3 may activate the water discharge pump 32 until the high water level is not detected by the high water level sensor 283.

In addition, the controller 3 may control the on/off operation of the at least one cooking heater 18*n* and the convection fan 18 according to a user's control command from the plurality of manipulation switches to allow the cooking chamber 15 to be heated.

Figure 8:
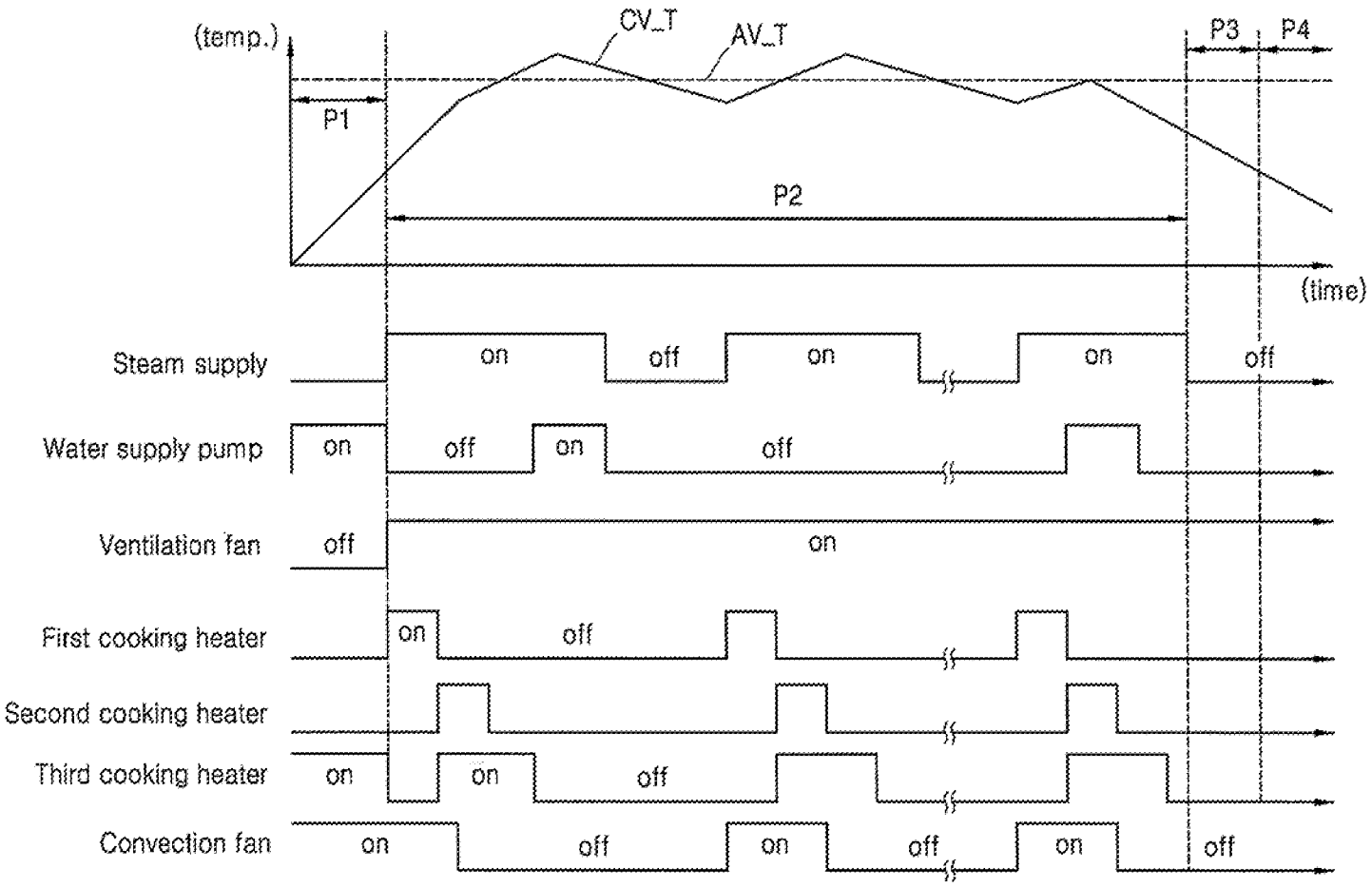
FIG. 8 is a timing diagram illustrating a control process of steam supply and oven cooking by the controller shown in FIG. 7.

FIG. 8 is a timing diagram illustrating a steam supply and oven cooking control process by the controller shown in FIG. 7. Referring to FIG. 8, the controller 3 may control the on/off operation of at least one cooking heater 18*n*, the convection fan 18, and the steam supply 21 according to an user's control command from the plurality of manipulation switches.

The user may set a cooking time and a cooking type via the plurality of manipulation switches of the controller 3 based on a type and material of food to be cooked. Therefore, the controller 3 may read a control command according to the user setting option from a memory and sequentially activates the steam supply 21, the at least one cooking heater 18*n*, the convection fan 18, and/or the ventilation fan 18*a*, for example, according to the control command.

For example, a cooking duration according to the control command may be divided into a pre-heating duration P1 at which a heater begins to preheat the cooking chamber 15, a main-heating duration P2 for cooking food, a ventilation duration P3 for lowering a temperature of the cooking chamber 15, and a cooking ending duration P4 for performing a water discharge operation. Accordingly, for the pre-heating duration P1, the controller 3 may activate the water supply pump 31 or the water discharge pump 32 based on a result of detecting the water level of the steam supply 21 using the low water-level sensor 282 and the high water-level sensor 283 to adjust the water level of the steam supply 21 to a predefined water level. For example, the controller 3 may activate the water supply pump 31 or the water discharge pump 32 such that the water-level h in the steam generator 223 is maintained at 25% of the height H of the team supply 21 under a conditions of maintaining the temperature of the steam supply 21 at 180° C. For this purpose, the low water-level sensor 282 may be configured to be positioned at up to 25% of the height H of the steam supply 21.

Further, for the pre-heating duration P1, the controller 3 may selectively activate at least one cooking heater of the plurality of cooking heaters 18*n* and the convection fan 18 to allow the cooking chamber 15 to be heated. Thereafter, for the main-heating duration P2 for cooking, the controller 3 may activate the steam supply 21 for a predetermined duration based on the control command such that the steam supply 21 supplies the steam into the cooking chamber 15. With this structure, even for the main-heating duration P2, the controller 3 may activate the water supply pump 31 or the water discharge pump 32 so that the water-level h in the steam supply 21 is maintained at 25% of the height H of the steam supply 21.

Further, for the main-heating duration P2 for cooking, the controller 3 may selectively activate the at least one cooking heater of the plurality of cooking heaters 18*n* and convection fan 18 to allow the cooking chamber 15 to be heated. With this structure, the controller 3 may selectively activate the at least one cooking heater and convection fan 18 such that a temperature CV_T in the cooking chamber 15 may maintain a reference temperature AV_T according to the control command.

For the pre-heating duration P1 and main-heating duration P2 for cooking, the controller 3 may detect an inner temperature of the steam supply 21 using the thermistor 23 disposed in the steam supply 21. Further, when the temperature detected by the thermistor 23 is above a predetermined temperature, the steam generation of the steam generator 223 may be stopped.

For the ventilation duration P3 after the cooking duration, the controller 3 may deactivate the steam supply 21, the plurality of cooking heaters 18*n*, and the convection fan 18, except for the ventilation fan 18*a*, thereby performing ventilation inside of the cooking chamber 15. Thereafter, the controller 3 may activate the water discharge pump 32 far the cooking ending duration P4 to allow the water discharge operation to proceed.

Figure 9:
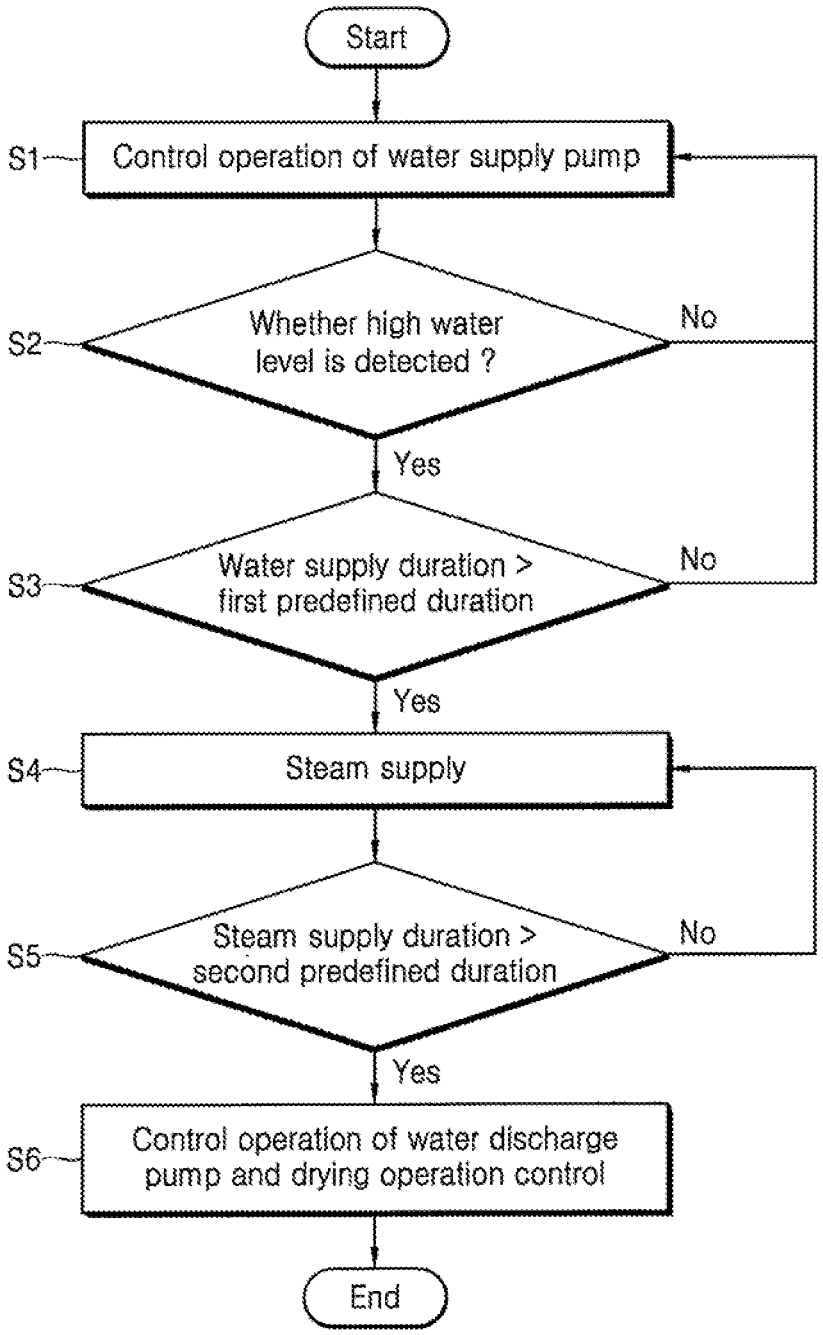
FIG. 9 is a flow chart sequentially illustrating a control sequence of cooking chamber cleaning by the controller shown in FIG. 7.
Figure 10:
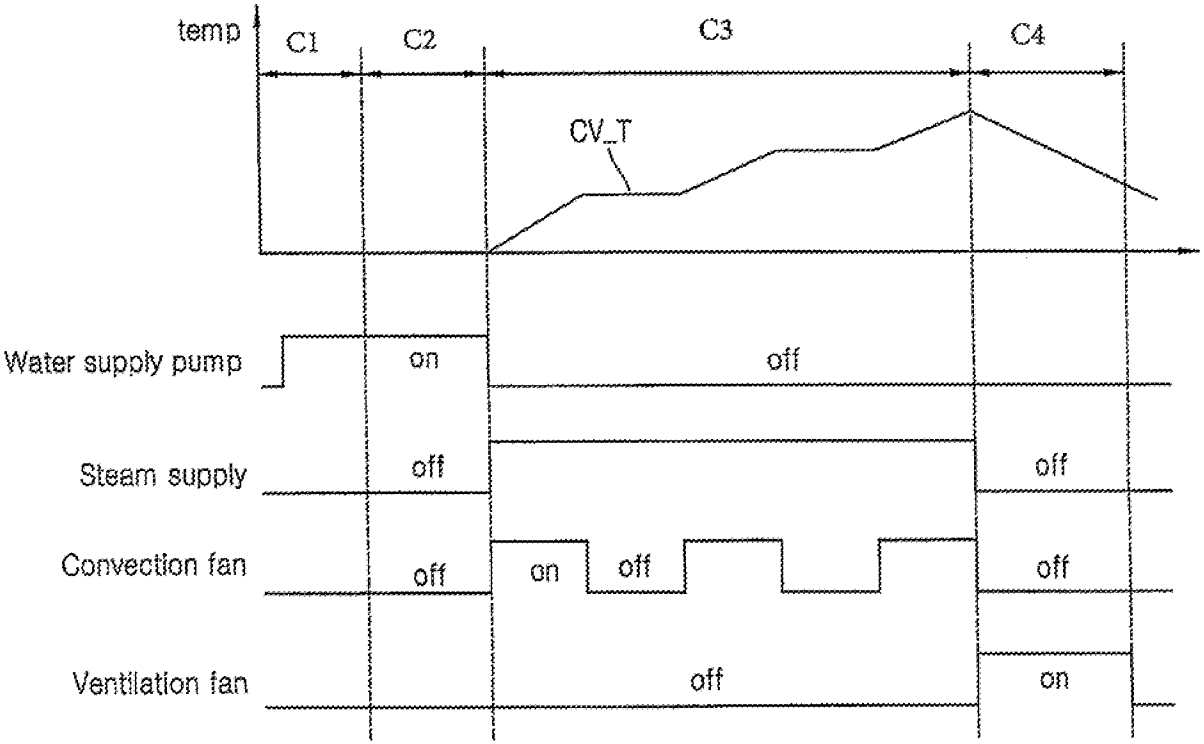
FIG. 10 is a timing diagram illustrating a cooking chamber cleaning process under control of the electrical cooking appliance by the controller shown in FIG. 7.

FIG. 9 is a flow chart sequentially illustrating a control sequence of cooking chamber cleaning by the controller shown in FIG. 7. FIG. 10 is a timing diagram illustrating a cooking chamber cleaning process under control of the electrical cooking appliance by the controller shown in FIG. 7.

Referring to FIG. 9 and FIG. 10, the controller 3 may control the on/off operation of the at least one cooking heater 18*n* and convection fan 18, and the steam supply 21 when performing an automatic cleaning operation, according to the user's control command from the plurality of manipulation switches. When the user wants to perform inner cleaning of the cooking chamber 15, the user may perform the cooking chamber cleaning operation via the plurality of manipulation switches of the controller 3. The controller 3 may read the control command from a memory according to a cooking chamber cleaning option, and then, based on the control command, sequentially activate the water supply pump 31, steam supply 21, at least one cooking heater 18*n*, convection fan 18, water discharge pump 32 and ventilation fan 18*a*.

For example, a cooking chamber cleaning execution duration according to the control command may be divided into a water supply preparation duration C1 in which the water supply pump 31 is activated such that water is supplied to the steam supply 21 and the condensed water storage 26, a cooking chamber water supply duration C2 in which hot water is supplied to an inner wall and a floor of the cooking chamber 15, a cleaning duration C3 for cleaning the cooking chamber 15 using high temperature air and steam, and a cleaning ending duration C4 for drying and water discharging. For the water supply preparation duration C1, the controller 3 may operate the water supply pump 31 to fill water in the steam supply 21 and condensed water storage 26 until the water-level is detected by the high water-level sensor 283 in the condensed water storage 26.

When the high water-level of the steam supply 21 and the condensed water storage 26 is detected by the high water-level sensor 283, the steam generator 223 and water supply pump 31 of the steam supply device 200 may continue to operate for the cooking chamber water supply duration C2 so that hot water is supplied to the walls and floor of the cooking chamber 15. The cooking chamber water supply duration C2 refers to a duration from a time when the high water-level is detected by the high water-level sensor 283 to a time when a predefined amount of water is filled from the bottom of the cooking chamber 15. The cooking chamber water supply duration C2 may be set to a predefined value based on a size of the cooking chamber 15 and an experimental value.

When a predetermined amount of water has been filled from the bottom of the cooking chamber 15 for the cooking chamber water supply duration C2, the controller 3 may turn off the water supply pump 31 and maintain the turned on state of the steam supply device 200.

For the cleaning duration C3, the controller 3 may activate the steam supply device 200 continuously for a predefined second duration or activate the steam supply device in a divided manner on a timer-based duration basis, to ensure that hot steam is supplied into the cooking chamber 15. With this structure, the controller 3 may operate the water discharge pump 32 for a predetermined duration to lower the water-level h in the steam generator 223 to 25% of the H of the steam supply 21. Further, the controller 3 may activate the water supply pump 31 and the water discharge pump 32 such that the water-level h in the steam generator 223 is maintained at 25% of the height. H of the steam supply 21 for the duration of supplying the hot steam into the cooking chamber 15.

Further, for the cleaning duration C3 for cleaning the cooking chamber, the controller 3 may selectively activate the convection fan 18 and at least one cooking heater 18*n* in a divided manner on a timer-based duration basis such that the interior of the cooking chamber 15 may be automatically cleaned in a high temperature environment. For the cleaning ending duration C4 after the cooking chamber cleaning ends, the controller 3 may stop the operation of the steam supply device 200 and the cooking heater 18*n* and the convection fan 18 and activate only the ventilation fan 18*a* to allow the cooking chamber 15 to be dry, and, further allow hot water that has been filled onto the bottom of the cooking chamber 15 to be discharged.

The controller 3 may display or output the water level of the steam supply 21 and the presence or absence of the water tank 35 on the display panel 3*a* or via an alarm generation speaker for the cleaning duration of the cooking chamber 15 and for the duration of cooking of the food.

As described above, in the electrical cooking appliance according to an embodiment, the steam supply device 200 may perform the water supply and steam supply process for the inner cleaning of the cooking chamber in sequence. Thus, inner cleaning of the cooking chamber 15 may be performed automatically. Thus, convenience and satisfaction of the user due to automatic cleaning of the cooking chamber 15 may be further improved.

Further, improving water-level sensing and water-level control functions of the steam supply device 200 provided in the electrical cooking appliance may allow the steam generation and cooking efficiency and automatic cleaning efficiency of the cooking chamber 15 to be further increased. Furthermore, the water supply pump 31 may be controlled in real time to supply the water from the water tank 35 to the steam supply device 200 to ensure that the water quantity required to clean the cooking chamber and the water quantity required to generate steam may be met. Also, the water-level status stored in the steam supply device 200 and the mounted or dismounted state of the water tank 35 may be informed in real time on the display panel 3*a* or via the sound alarm. This may increase utilization of the steam supply device 200. User satisfaction and reliability of the electrical cooking appliance having the steam supply device 200 may be improved.

Embodiments disclosed herein provide an electrical cooking appliance to automatically perform inner cleaning of a cooking chamber, in which a steam supply device automatically executes sequentially water receiving and steam generation and supply into the cooking chamber so that the cooking chamber is cleaned. Further, embodiments disclosed herein provide an electrical cooking appliance in which steam generation and cooking efficiency in addition to automatic cleaning efficiency may increase by improving water-level sensing and water-level control functions to ensure that water supply and steam supply operations for inner cleaning of the cooking chamber are performed.

Purposes of embodiments are not limited to the above-mentioned purpose. Other purposes and advantages as not mentioned above may be understood from following descriptions and more clearly understood from embodiments. Further, it will be readily appreciated that the purposes and advantages may be realized by features and combinations thereof as disclosed in the claims.

Embodiments disclosed herein provide an electrical cooking appliance with automatic cleaning of a cooking chamber. The appliance may include a steam supply device configured to generate steam and supply the steam to the cooking chamber; a water supply pump that supplies water from a water tank to the steam supply device; a water discharge pump that collects condensed water from the steam supply device into the water tank; and a controller configured to activate the water supply pump to supply water to the cooking chamber to clean the cooking chamber; and activate the steam supply device to supply steam to the cooking chamber to clean the cooking chamber.

The steam supply device may include a steam supply configured to generate steam and supply the steam to the cooking chamber through a steam supply channel; a first channel that extends from the steam supply to the cooking chamber; a condensed water storage connected to an end of a second channel branching from the first channel and configured to collect the condensed water from the steam supply and store therein the condensed water; a water supply channel that supplies water from the water supply pump to the steam supply; a collection channel that connects the condensed water storage and the water supply channel to each other; and a water-level sensing module or sensor configured to detect a water-level of the steam supply based on a water-level of the condensed water storage detected using a low water-level sensor and a high water-level sensor. The controller may be further configured to activate the water supply pump for a water supply preparation duration for cleaning of the cooking chamber, such that water is supplied to the steam supply and the condensed water storage until the high water-level sensor of the water-level sensing module detects a high water level.

The controller may be further configured to when the high water-level is detected by the high water-level sensor of the water-level sensing module, continue to activate the steam supply and the water supply pump for a first predefined duration from a time when the water-level is detected by the high water-level sensor, such that water is supplied and filled onto an inner bottom face of the cooking chamber. The controller may be further configured to continuously activate the steam supply device for a second predefined duration, or activate the steam supply device in a divided time manner on a timer-based duration basis, such that hot steam is supplied into the cooking chamber for cleaning of the cooking chamber; and selectively activate a convection fan and at least one cooking heater disposed on the cooking chamber for the second predefined duration to heat the cooking chamber.

Each of the low water-level sensor and the high water-level sensor may include a corresponding working electrode. The working electrode may cooperate with a common electrode and be disposed at an upper level of the condensed water storage and face downwardly to detect a water level inside the condensed water storage in real time. The controller may be further configured to determine that a water level inside of the condensed water storage is equal to a water level inside of the steam supply.

The controller may be further configured to when, for a food cooking duration and a cleaning duration of the cooking chamber, the water-level inside of the steam supply as detected by the low water-level sensor remains at a low water-level for a duration equal to or larger than a predefined duration, activate the water supply pump for a predefined duration or until a high water level is detected by the high water-level sensor; and when, for a food cooking duration and a cleaning duration of the cooking chamber, the water-level inside the steam supply as detected by the high water-level sensor remains at a high water-level for a duration equal to or larger than a predefined duration, activate the water discharge pump for a predefined duration or until the high water-level is not detected by the high water-level sensor. The controller may be further configured to detect a water-level of the steam supply using the low water-level sensor and the high water-level sensor from a pre-heating duration for which cooking begins to a ventilation duration for which cooking ends; and activate the water supply pump or the water discharge pump based on the detection result of the water level to adjust the water level of the steam supply to be a predefined water level. The controller may be further configured to receive in real tune a signal indicating whether the water tank is mounted, for a cooking duration and for a cleaning duration of the cooking chamber; and output a mounted or dismounted state of the water tank on a display panel or via an alarm generation speaker. The controller may also be configured to detect a water level of the steam supply device using a water-level sensing module having a low water level sensor and a high water level sensor; receive in real time a signal indicating whether the water tank is mounted from a water tank sensor; control an on or off operation of the water supply pump or the water discharge pump based on a water-level change of the steam supply device as detected by the water-level sensing module; and output a water-level status of the steam supply device and/or a mounted or dismounted state of the water tank on a display panel or via an alarm generation speaker.

The electrical cooking appliance according to embodiments may automatically perform the inner cleaning of the cooking chamber by automatically and sequentially performing the water supply and steam supply process for the inner cleaning of the cooking chamber in the steam supply device. Thus, convenience and satisfaction of the user according to the cooking chamber automatic cleaning may be further improved.

Further, improving water-level sensing and water-level control functions of the steam supply device provided in the electrical cooking appliance may allow increased steam generation and cooking efficiency in addition to automatic cleaning efficiency of the cooking chamber. Furthermore, water may be supplied from the water tank to the steam generation device while controlling the water supply pump in real time to ensure that a water quantity required to clean the cooking chamber and a water quantity required to generate steam may be met. Also, the water-level state stored in the steam generator and the mounted or detached state of the water tank to or from the appliance may be informed in real time on a display panel or via a sound alarm. This may increase utilization of the steam supply device and improve user satisfaction and reliability of the electrical cooking appliance equipped with the steam supply device.

Although the present disclosure has been described with reference to the drawings illustrating the present disclosure, embodiments are not limited to the embodiments and drawings disclosed in the present specification. It will be apparent that various modifications may be made by those skilled in the art within the scope. In addition, it should be appreciated that effects to be achieved from configurations as not expressly mentioned may be acknowledged.

It will be understood that when an element or layer is referred to as being "on" another element or layer, the element or layer can be directly on another element or layer or intervening elements or layers. In contrast, when an element is referred to as being "directly on" another element or layer, there are no intervening elements or layers present. As used herein, the term "and/or" includes any and all combinations of one or more of the associated listed items.

It will be understood that, although the terms first, second, third, etc., may be used herein to describe various elements, components, regions, layers and/or sections, these elements, components, regions, layers and/or sections should not be limited by these terms. These terms are only used to distinguish one element, component, region, layer or section from another region, layer or section. Thus, a first element, component, region, layer or section could be termed a second element, component, region, layer or section without departing from the teachings of the present invention.

Spatially relative terms, such as "lower" "upper" and the like, may be used herein for ease of description to describe the relationship of one element or feature to another element (s) or feature(s) as illustrated in the figures. It will be understood that the spatially relative terms are intended to encompass different orientations of the device in use or operation, in addition to the orientation depicted in the figures. For example, if the device in the figures is turned over, elements described as "lower" relative to other elements or features would then be oriented "upper" relative to the other elements or features. Thus, the exemplary term "lower" can encompass both an orientation of above and below. The device may be otherwise oriented (rotated 90 degrees or at other orientations) and the spatially relative descriptors used herein interpreted accordingly.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," when used, in this specification, specify the presence of stated features, integers, steps, operations, elements, and/or components, but do not preclude the presence or addition of one or more other features, integers, steps, operations, elements, components, and/or groups thereof.

Embodiments of the disclosure are described herein with reference to cross-section illustrations that are schematic illustrations of idealized embodiments (and intermediate structures) of the disclosure. As such, variations from the shapes of the illustrations as a result, for example, of manufacturing techniques and/or tolerances, are to be expected. Thus, embodiments of the disclosure should not be construed as limited to the particular shapes of regions illustrated herein but are to include deviations in shapes that result, for example, from manufacturing.

Unless otherwise defined, all terms including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

Any reference in this specification to "one embodiment," "an embodiment," "example embodiment," etc., means that a particular feature, structure, or characteristic described in connection with the embodiment is included in at least one embodiment. The appearances of such phrases in various places in the specification are not necessarily all referring to the same embodiment. Further, when a particular feature, structure, or characteristic is described in connection with any embodiment, it is submitted that it is within the purview of one skilled in the art to effect such feature, structure, or characteristic in connection with other ones of the embodiments.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. An electrical cooking appliance with automatic cleaning of a cooking chamber, the appliance comprising:

a steam supply device configured to generate steam and supply the steam to the cooking chamber;

a water supply pump that supplies water from a water tank to the steam supply device;

a water discharge pump that collects condensed water from the steam supply device into the water tank; and a controller configured to:

activate the water supply pump to supply water to the cooking chamber to clean the cooking chamber; and activate the steam supply device to supply steam to the cooking chamber to clean the cooking chamber, wherein the steam supply device includes:

a steam supply configured to generate steam and supply the steam to the cooking chamber through a steam supply channel; and a water-level sensor configured to detect a water-level of the steam supply based on a water-level using a low water-level sensor and a high water-level sensor, wherein the controller is further configured to:

when the high water-level is detected by the high water-level sensor of the water-level sensor, continue to activate the steam supply and the water supply pump for a first predefined duration from a time when the water-level is detected by the high water-level sensor, such that water is supplied and filled onto an inner bottom face of the cooking chamber.

2. The electrical cooking appliance of claim 1, wherein the steam supply device further includes:

a first channel that extends from the steam supply to the cooking chamber;

a condensed water storage connected to an end of a second channel branched from the first channel and configured to collect condensed water from the steam supply and store therein the condensed water;

a water supply channel that supplies water from the water supply pump to the steam supply; and a collection channel that connects the condensed water storage and the water supply channel to each other.

3. The electrical cooking appliance of claim 2, wherein the controller is further configured to:

activate the water supply pump for a water supply preparation duration for cleaning of the cooking chamber, such that water is supplied to the steam supply and the condensed water storage until the high water-level sensor of the water-level sensor detects a high water level.

4. The electrical cooking appliance of claim 3, wherein the controller is further configured to:

continuously activate the steam supply device for a second predefined duration, or activate the steam supply device in a divided time manner on a timer-based duration basis, such that hot steam is supplied into the cooking chamber for cleaning of the cooking chamber; and selectively activate a convection fan and at least one cooking heater disposed on the cooking chamber for the second predefined duration to heat the cooking chamber.

5. The electrical cooking appliance of claim 2, wherein each of the low water-level sensor and the high water-level sensor includes a working electrode, wherein the working electrode cooperates with a common electrode and is disposed at an upper level of the condensed water storage and faces downwardly to detect a water level inside of the condensed water storage in real time, and wherein the controller is further configured to determine that a water level inside of the condensed water storage is equal to a water level inside of the steam supply.

6. The electrical cooking appliance of claim 5, wherein the controller is further configured to:

when, for a food cooking duration and a cleaning duration of the cooking chamber, the water-level inside of the steam supply as detected by the low water-level sensor remains at a low water-level for a duration equal to or larger than a predefined duration, activate the water supply pump for a predefined duration or until a high water level is detected by the high water-level sensor; and when, for the food cooking duration and the cleaning duration of the cooking chamber, the water-level inside of the steam supply as detected by the high water-level sensor remains at a high water-level for a duration equal to or larger than a predefined duration, activate the water discharge pump for a predefined duration or until the high water-level is not detected by the high water-level sensor.

7. The electrical cooking appliance of claim 2, wherein the controller is further configured to:

detect a water-level of the steam supply using the low water-level sensor and the high water-level sensor from a pre-heating duration for which cooking begins to a ventilation duration for which cooking ends; and activate the water supply pump or the water discharge pump based on the detection result of the water level to adjust the water level of the steam supply to be a predefined water level.

8. The electrical cooking appliance of claim 2, wherein the controller is further configured to:

receive in real time a signal indicating whether the water tank is mounted, for a cooking duration and for a cleaning duration of the cooking chamber; and output a mounted or dismounted state of the water tank on a display panel or via an alarm generation speaker.

9. The electrical cooking appliance of claim 2, wherein the controller is further configured to:

detect a water level of the steam supply device using the water-level sensor having the low water level sensor and the high water level sensor;

receive in real time a signal indicating whether the water tank is mounted from a water tank sensor;

control an on or off operation of the water supply pump or the water discharge pump based on a water-level change of the steam supply device as detected by the water-level sensor; and output a water-level status of the steam supply device and/or a mounted or dismounted state of the water tank on a display panel or via an alarm generation speaker.

10. An electrical cooking appliance with automatic cleaning of a cooking chamber, the appliance comprising:

a steam supply device configured to generate steam and supply the steam to the cooking chamber;

a water supply pump that supplies water from a water tank to the steam supply device;

a water discharge pump that collects condensed water from the steam supply device into the water tank;

a water-level sensor configured to detect a water-level in the steam supply device; and a controller configured to activate the water supply pump to supply water to the cooking chamber and activate the steam supply device to supply steam to the cooking chamber to clean the cooking chamber based on a detection result of the water-level sensor, wherein the steam supply device includes a steam supply configured to generate steam and supply the steam to the cooking chamber through a steam supply channel, wherein the water-level sensor is configured to detect a water-level of the steam supply based on a water-level using a low water-level sensor and a high water-level sensor, and wherein the controller is further configured to:

when the high water-level is detected by the high water-level sensor of the water-level sensor, continue to activate the steam supply and the water supply pump for a first predefined duration from a time when the water-level is detected by the high water-level sensor, such that water is supplied and filled onto an inner bottom face of the cooking chamber.

11. The electrical cooking appliance of claim 10, wherein the steam supply device further includes:

a first channel that extends from the steam supply to the cooking chamber;

a condensed water storage connected to an end of a second channel branched from the first channel and configured to collect condensed water from the steam supply and store therein the condensed water;

a water supply channel that supplies water from the water supply pump to the steam supply; and a collection channel that connects the condensed water storage and the water supply channel to each other.

12. The electrical cooking appliance of claim 11, wherein the controller is further configured to:

continuously activate the steam supply device for a second predefined duration, or activate the steam supply device in a divided time manner on a timer-based duration basis, such that hot steam is supplied into the cooking chamber for cleaning of the cooking chamber; and selectively activate a convection fan and at least one cooking heater disposed on the cooking chamber for the second predefined duration to heat the cooking chamber.

13. The electrical cooking appliance of claim 11, wherein each of the low water-level sensor and the high water-level sensor includes a working electrode, wherein the working electrode cooperates with a common electrode and is disposed at an upper level of the condensed water storage and faces downwardly to detect a water level inside of the condensed water storage in real time, and wherein the controller is further configured to determine that a water level inside of the condensed water storage is equal to a water level inside of the steam supply.

14. The electrical cooking appliance of claim 13, wherein the controller is further configured to:

when, for a food cooking duration and a cleaning duration of the cooking chamber, the water-level inside of the steam supply as detected by the low water-level sensor remains at a low water-level for a duration equal to or larger than a predefined duration, activate the water supply pump for a predefined duration or until a high water level is detected by the high water-level sensor; and when, for the food cooking duration and the cleaning duration of the cooking chamber, the water-level inside of the steam supply as detected by the high water-level sensor remains at a high water-level for a duration equal to or larger than a predefined duration, activate the water discharge pump for a predefined duration or until the high water-level is not detected by the high water-level sensor.

15. The electrical cooking appliance of claim 11, wherein the controller is further configured to:

detect a water-level of the steam supply using the low water-level sensor and the high water-level sensor from a pre-heating duration for which cooking begins to a ventilation duration for which cooking ends; and activate the water supply pump or the water discharge pump based on the detection result of the water level to adjust the water level of the steam supply to be a predefined water level.

16. The electrical cooking appliance of claim 11, wherein the controller is further configured to:

receive in real time a signal indicating whether the water tank is mounted, for a cooking duration and for a cleaning duration of the cooking chamber; and output a mounted or dismounted state of the water tank on a display panel or via an alarm generation speaker.

17. The electrical cooking appliance of claim 11, wherein the controller is further configured to:

detect a water level of the steam supply device using the water-level sensor having the low water level sensor and the high water level sensor;

receive in real time a signal indicating whether the water tank is mounted from a water tank sensor;

control an on or off operation of the water supply pump or the water discharge pump based on a water-level change of the steam supply device as detected by the water-level sensor; and output a water-level status of the steam supply device and/or a mounted or dismounted state of the water tank on a display panel or via an alarm generation speaker.

18. An electrical cooking appliance with automatic cleaning of a cooking chamber, the appliance comprising:

a steam supply device configured to generate steam and supply the steam to the cooking chamber;

a fluid supply pump that supplies fluid from a fluid tank to the steam supply device;

a fluid discharge pump that collects condensed fluid from the steam supply device into the fluid tank;

a fluid-level sensor configured to detect a fluid-level in the steam supply device; and a controller configured to activate the fluid supply pump to supply fluid to the cooking chamber and activate the steam supply device to supply steam to the cooking chamber to clean the cooking chamber based on a detection result of the fluid-level sensor, wherein the steam supply device includes a steam supply configured to generate steam and supply the steam to the cooking chamber through a steam supply channel, wherein the fluid-level sensor is configured to detect a fluid-level of the steam supply based on a fluid-level using a low fluid-level sensor and a high fluid-level sensor, and wherein the controller is further configured to:

when the high fluid-level is detected by the high fluid-level sensor of the fluid-level sensor, continue to activate the steam supply and the fluid supply pump for a first predefined duration from a time when the fluid-level is detected by the high fluid-level sensor, such that fluid is supplied and filled onto an inner bottom face of the cooking chamber.

* * * * *